US006811499B1

(12) United States Patent
Hsien

(10) Patent No.: US 6,811,499 B1
(45) Date of Patent: Nov. 2, 2004

(54) GOLF TEE STRUCTURE WITH ADJUSTABLE HEIGHT

(76) Inventor: Chih-Ching Hsien, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/412,353

(22) Filed: Apr. 9, 2003

(51) Int. Cl.[7] ..... A63B 57/00
(52) U.S. Cl. ..... 473/396; 473/400
(58) Field of Search ..... 473/387–403

(56) References Cited

U.S. PATENT DOCUMENTS 1,783,211 A * 12/1930 Baldwin ..... 473/387
3,406,977 A * 10/1968 Voelkerding ..... 473/398
4,017,087 A * 4/1977 Bruno ..... 473/133
4,516,780 A * 5/1985 Tabet ..... 473/398
4,905,999 A * 3/1990 Voinovich et al. ..... 473/386
5,738,598 A * 4/1998 Wu ..... 473/392
6,083,121 A * 7/2000 Hovey ..... 473/396

* cited by examiner

*Primary Examiner*—Steven Wong

(57) ABSTRACT

A golf tee structure includes a lower body, and an upper body. The lower body has an inside formed with a hollow portion. The upper body is adjustably mounted on the lower body and has a lower portion formed with an adjusting rod retractably mounted in the hollow portion of the lower body. Thus, the height of the golf tee structure can be adjusted arbitrarily so as to fit the requirement of users of different stature. In addition, the adjusting rod of the upper body can be locked on the hollow portion of the lower body rigidly and stably.

11 Claims, 6 Drawing Sheets

GOLF TEE STRUCTURE WITH ADJUSTABLE HEIGHT

BACKGROUND OF THE INVENTION

1. Field of the Invention

The present invention relates to a golf tee structure, and more particularly to a golf tee structure with an adjustable height.

2. Description of the Related Art

A conventional golf tee has a lower end formed with a pointed portion that can be inserted into the earth and an upper portion formed with a cone-shaped ball seat for receiving a golf ball. Thus, the conventional golf tee can be used to support the golf ball. However, the height of the conventional golf tee is fixed and cannot be adjusted to fit the requirement of users of different statures, thereby causing inconvenience to the user, and thereby limiting the versatility of the conventional golf tee.

SUMMARY OF THE INVENTION

The primary objective of the present invention is to provide a golf tee structure, wherein the height of the golf tee structure can be adjusted arbitrarily so as to fit the requirement of users of different statures.

Another objective of the present invention is to provide a golf tee structure that can be positioned rigidly and stably.

A further objective of the present invention is to provide a golf tee structure, wherein the adjusting rod of the upper body can be locked on the hollow portion of the lower body rigidly and stably.

In accordance with the present invention, there is provided a golf tee structure, comprising a lower body, and an upper body, wherein:

the lower body has an inside formed with a hollow portion; and the upper body is adjustably mounted on the lower body and has a lower portion formed with an adjusting rod retractably mounted in the hollow portion of the lower body.

Further benefits and advantages of the present invention will become apparent after a careful reading of the detailed description with appropriate reference to the accompanying drawings.

BRIEF DESCRIPTION OF THE DRAWINGS

FIG. 3 is a side plan cross-sectional view of the golf tee structure as shown in. FIG. 2;

DETAILED DESCRIPTION OF THE INVENTION

Figure 1:
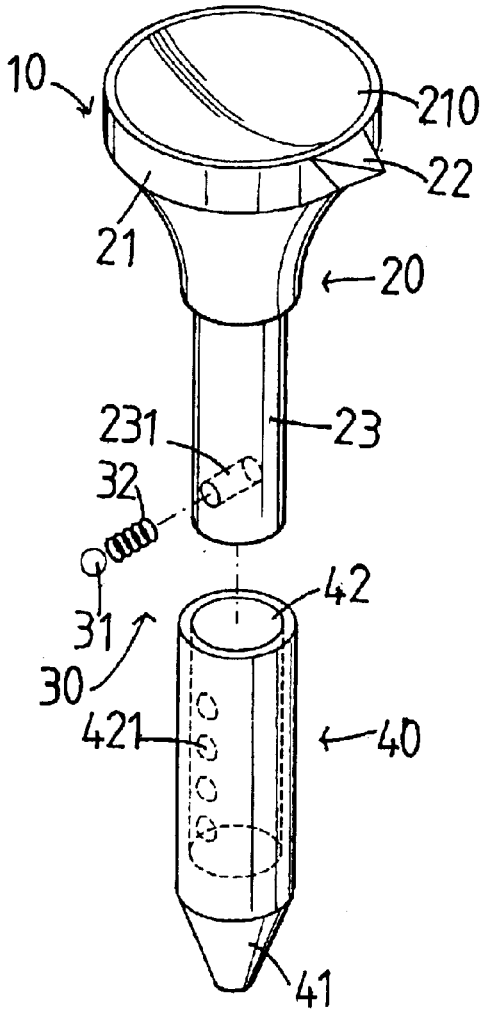
FIG. 1 is an exploded perspective view of the golf tee structure in accordance with the first embodiment of the present invention.
Figure 2:
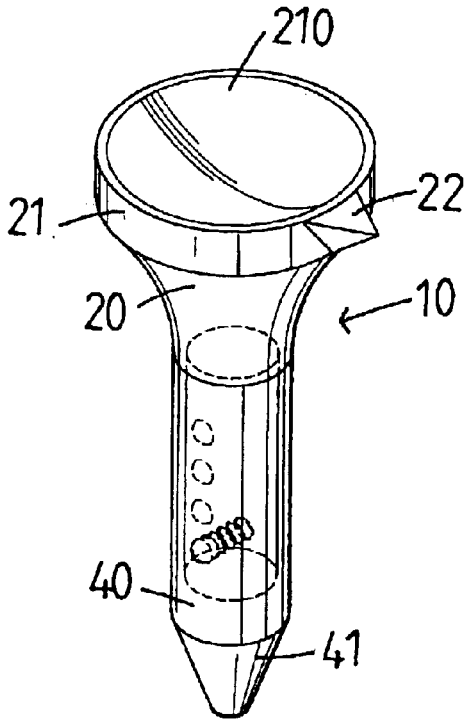
FIG. 2 is a perspective assembly view of the golf tee structure in accordance with the first embodiment of the present invention.
Figure 3:
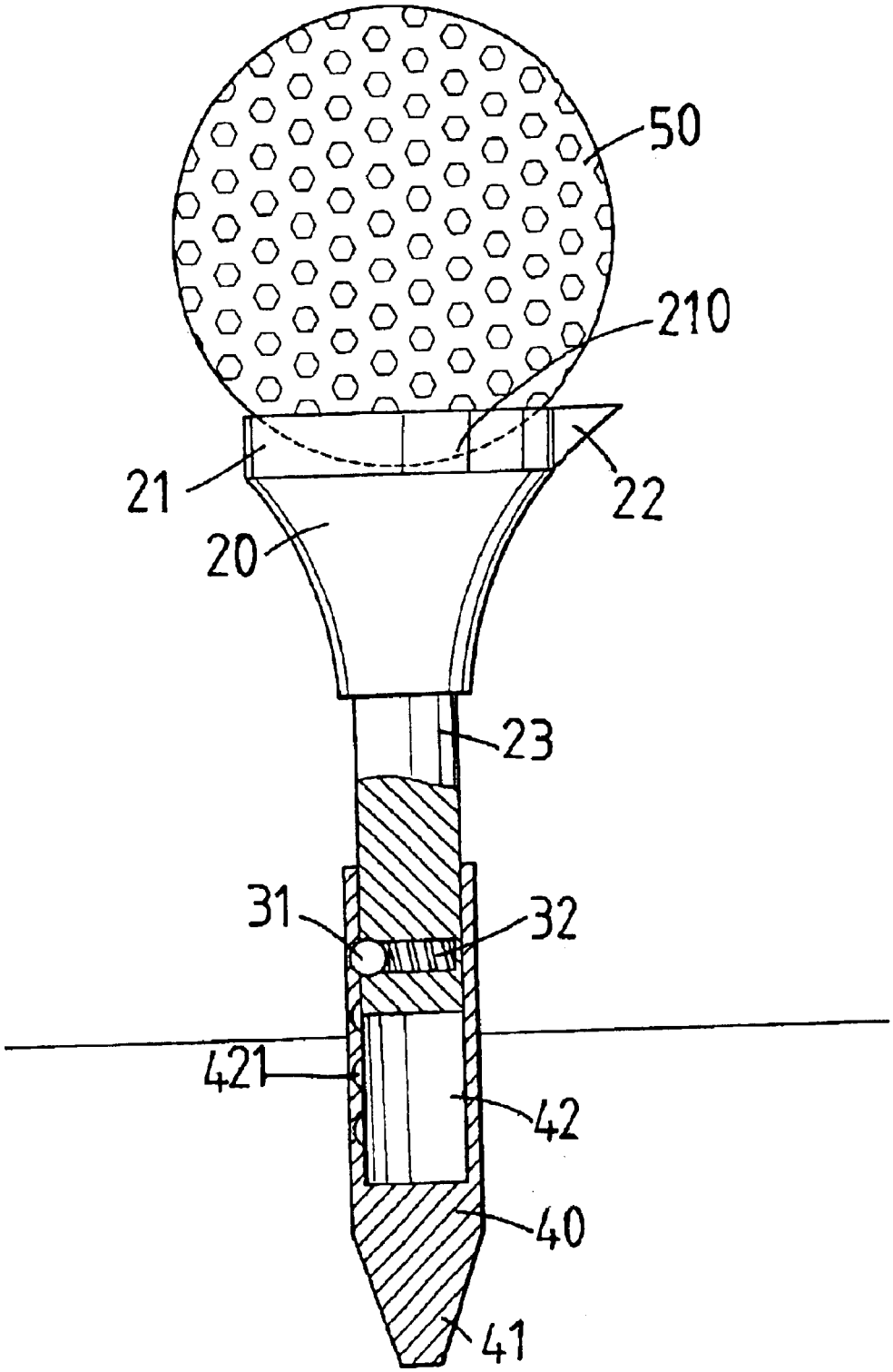

Referring to the drawings and initially to FIGS. 1–3, a golf tee structure 10 in accordance with the first embodiment of the present invention comprises a lower body 40, and an upper body 20.

The lower body 40 has a lower end formed with a pointed portion 41 that can be inserted into the earth. The lower body 40 has an inside formed with a hollow portion 42. The hollow portion 42 of the lower body 40 has a periphery formed with a plurality of positioning holes 421 which are arranged in line with each other.

The upper body 20 has a horn shape. The upper body 20 is adjustably mounted on the lower body 40. The upper body 20 has an upper portion formed with a cone shaped ball seat 21. The ball seat 21 of the upper body 20 has a top face formed with a concave portion 210 for receiving a golf ball 50 (see FIG. 3). The ball seat 21 of the upper body 20 has a side formed with a protruding pointer 22. Preferably, the pointer 22 of the upper body 20 has a sharp conic shape. In addition, the pointer 22 of the upper body 20 points to the travel direction of the golf ball 50, so as to provide in indication function to the golfer. The upper body 20 has a lower portion formed with a cylindrical adjusting rod 23 retractably mounted in the hollow portion 42 of the lower body 40. The adjusting rod 23 of the upper body 20 has a periphery formed with a receiving hole 231.

The golf tee structure 10 further comprises an adjusting mechanism 30 mounted between the adjusting rod 23 of the upper body 20 and the hollow portion 42 of the lower body 40 to adjust a relative position between the adjusting rod 23 of the upper body 20 and the hollow portion 42 of the lower body 40. The adjusting mechanism 30 includes a positioning ball 31 mounted in the receiving hole 231 of the upper body 20 and detachably locked in one of the positioning holes 421 of the lower body 40, and an elastic member 32 mounted in the receiving hole 23 of the upper body 20 and urged between the positioning ball 31 and a wall of the receiving hole 231 of the upper body 20.

Figure 4:
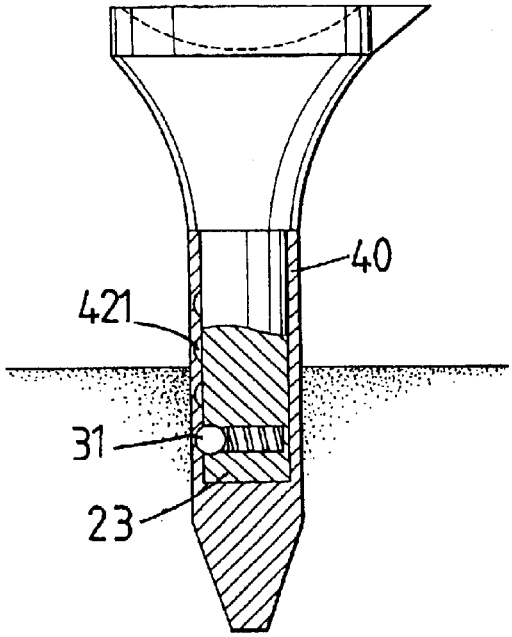
FIG. 4 is a schematic operational view of the golf tee structure as shown in FIG. 3 in adjustment.
Figure 5:
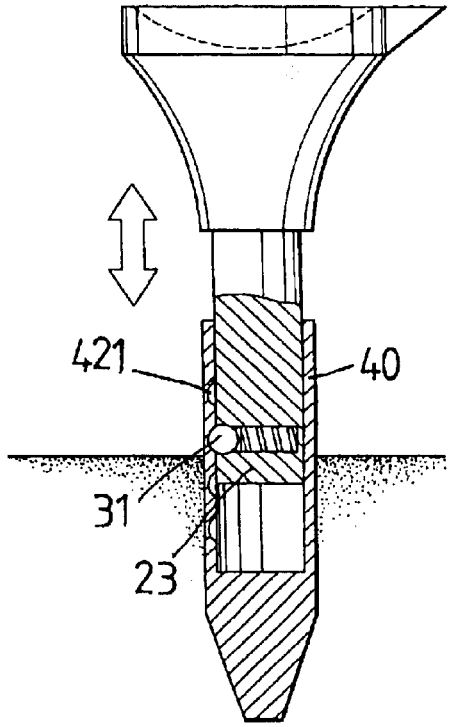
FIG. 5 is a schematic operational view of the golf tee structure as shown in FIG. 3 in adjustment.

In adjustment, the adjusting rod 23 of the upper body 20 can be moved in the hollow portion 42 of the lower body 40 from the position as shown in FIG. 3 to the position as shown in FIG. 4, so that the adjusting rod 23 of the upper body 20 is fully retracted into the hollow portion 42 of the lower body 40. Alternatively, the adjusting rod 23 of the upper body 20 can be moved in the hollow portion 42 of the lower body 40 from the position as shown in FIG. 4 to the position as shown in FIG. 5 or to the position as shown in FIG. 3, so that the adjusting rod 23 of the upper body 20 is extended outward from the hollow portion 42 of the lower body 40.

Thus, the relative position between the adjusting rod 23 of the upper body 20 and the hollow portion 42 of the lower body 40 can be adjusted arbitrarily, so that the height of the golf tee structure 10 can be adjusted arbitrarily so as to fit the requirement of users of different stature. In addition, the positioning ball 31 is locked in one of the positioning holes 421 of the lower body 40, so that the adjusting rod 23 of the upper body 20 can be locked on the hollow portion 42 of the lower body 40 rigidly and stably.

Figure 6:
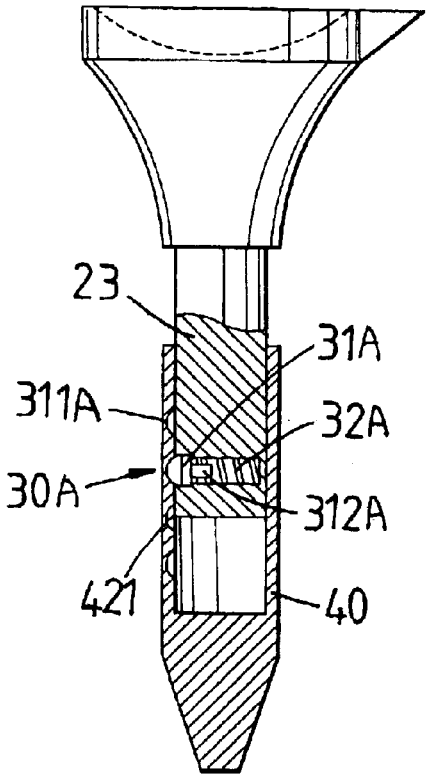
FIG. 6 is a side plan cross-sectional view of the golf tee structure in accordance with the second embodiment of the present invention.

Referring to FIG. 6, the golf tee structure in accordance with the second embodiment of the present invention is shown, wherein the adjusting mechanism 30A includes a positioning block 31A mounted in the receiving hole 231 of the upper body 20 and detachably locked in one of the positioning holes 421 of the lower body 40, and an elastic member 32A mounted in the receiving hole 231 of the upper body 20 and urged between the positioning block 31A and a wall of the receiving hole 231 of the upper body 20. Preferably, the positioning block 31 A has a first side formed with an arcuate positioning boss 311 A locked in one of the positioning holes 421 of the lower body 40 and a second side formed with a stub 312A secured on an end of the elastic member 32A.

Figure 7:
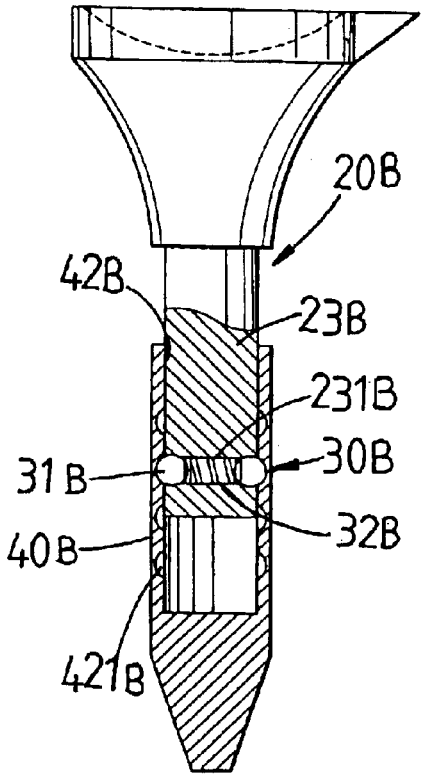
FIG. 7 is a side plan cross-sectional view of the golf tee structure in accordance with the third embodiment of the present invention.

Referring to FIG. 7, the golf tee structure in accordance with the third embodiment of the present invention is shown, wherein the adjusting rod 23B of the upper body 20B is formed with a receiving hole 231B extended through the adjusting rod 23B, the hollow portion 42B of the lower body 40B has two opposite sides each formed with a plurality of positioning holes 421B, and the adjusting mechanism 30B includes two opposite positioning balls 31B each mounted in the receiving hole 231B of the upper body 20B and detachably locked in one of the positioning holes 421B of the lower body 40B, and an elastic member 3213 mounted in the receiving hole 231B of the upper body 20B and urged between the two positioning balls 31B.

Figure 8:
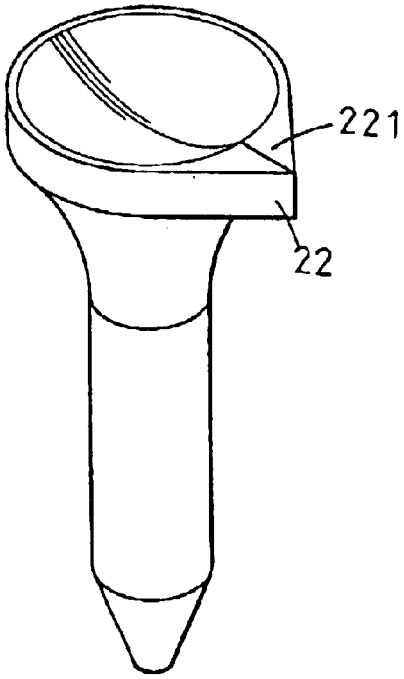
FIG. 8 is a perspective view of the golf tee structure in accordance with the fourth embodiment of the present invention.
Figure 9:
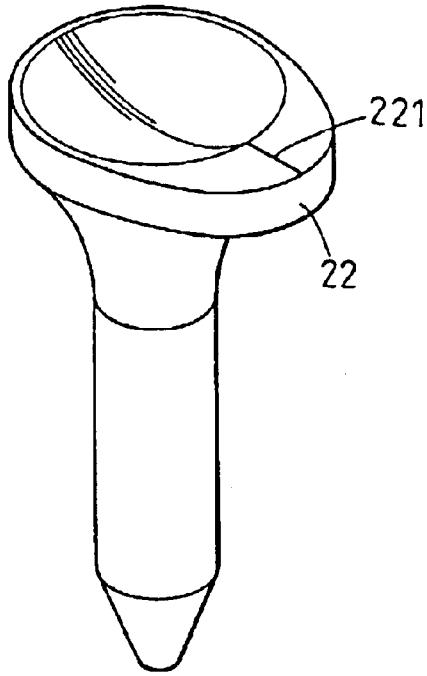
FIG. 9 is a perspective view of the golf tee structure in accordance with the fifth embodiment of the present invention.

Referring to FIGS. 8 and 9, the golf tee structure in accordance with the fourth and fifth embodiments of the present invention is shown, wherein the pointer 22 of the upper body 20 has different configuration and is provided with an indication line 221, so that the user can control the travel direction of the golf ball 50.

Figure 10:
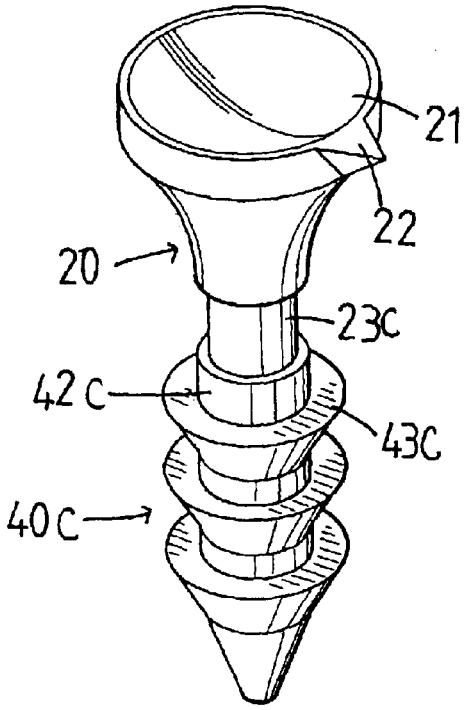
FIG. 10 is a perspective view of the golf tee structure in accordance with the sixth embodiment of the present invention.
Figure 11:
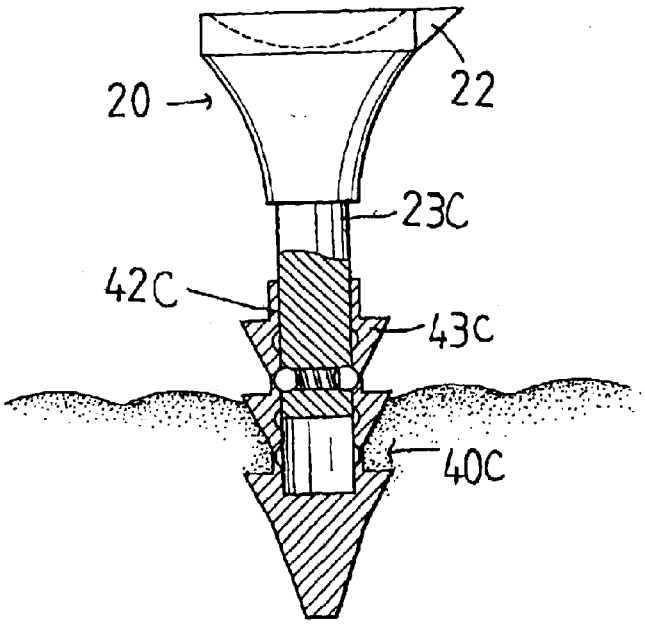
FIG. 11 is a side plan partially cross-sectional view of the golf tee structure as shown in FIG. 10.

Referring to FIGS. 10 and 11, the golf tee structure in accordance with the sixth embodiment of the present invention is shown, wherein the hollow portion 42C of the lower body 40C has an outer wall formed with a plurality of barb-shaped locking portions 43C, so that the lower body 40C can be secured in the earth rigidly and stably.

Although the invention has been explained in relation to its preferred embodiment(s) as mentioned above, it is to be understood that many other possible modifications and variations can be made without departing tom the scope of the present invention. It is, therefore, contemplated that the appended claim or claims will cover such modifications and variations that fall within the true scope of the invention.

What is claimed is:

1. A golf tee structure, comprising a lower body, and an upper body, wherein:

the lower body has an inside formed with a hollow portion;

the upper body is adjustably mounted on the lower body and has a lower portion formed with an adjusting member retractably mounted in the hollow portion of the lower body;

the adjusting member of the upper body has a periphery formed with a receiving hole;

the hollow portion of the lower body has a periphery formed with a plurality of positioning holes;

a positioning ball is mounted in the receiving hole of the adjusting member of the upper body and detachably locked in one of the positioning holes of the lower body; and an elastic member is mounted in the receiving hole of the adjusting member of the upper body and urged between the positioning ball and a wall of the receiving hole of the upper body.

2. The golf tee structure in accordance with claim 1, wherein the lower body has a lower end formed with a pointed portion.

3. The golf tee structure in accordance with claim 1, wherein the upper body has a horn shape.

4. The golf tee structure in accordance with claim 1, wherein the upper body has an upper portion formed with a cone-shaped ball seat.

5. The golf tee structure in accordance with claim 4, wherein the ball seat of the upper body has a top face formed with a concave portion.

6. The golf tee structure in accordance with claim 4, wherein the ball seat of the upper body has a side formed with a protruding pointer.

7. The golf tee structure in accordance with claim 6, wherein the pointer of the upper body is provided with an indication line.

8. The golf tee structure in accordance with claim 1, wherein the hollow portion of the lower body has an outer wall formed with a plurality of barb-shaped locking portions.

9. A golf tee structure, comprising a lower body, and an upper body, wherein:

the lower body has an inside formed with a hollow portion;

the upper body is adjustably mounted on the lower body and has a lower portion formed with an adjusting member retractably mounted in the hollow portion of the lower body;

the adjusting member of the upper body has a periphery formed with a receiving hole;

the hollow portion of the lower body has a periphery formed with a plurality of positioning holes;

a positioning block is mounted in the receiving hole of the adjusting member of the upper body and detachably locked in one of the positioning holes of the lower body; and an elastic member is mounted in the receiving bole of the adjusting member of the upper body and urged between the positioning block and a wall of the receiving hole of the upper body.

10. A golf tee structure, comprising a lower body, and an upper body, wherein:

the lower body has an inside formed with a hollow portion;

the upper body is adjustably mounted on the lower body and has a lower portion formed with an adjusting member retractably mounted in the hollow portion of the lower body;

the adjusting member of the upper body is formed with a receiving hole extended through the adjusting rod;

the hollow portion of the lower body has two opposite sides each formed with a plurality of positioning holes;

two opposite positioning balls are mounted in the receiving hole of the adjusting member of the upper body and each of the two opposite positioning balls is detachably locked in one of the positioning holes of the lower body; and an elastic member mounted in the receiving hole of the adjusting member of the upper body and urged between the two positioning balls.

11. The golf tee structure in accordance with claim 9, wherein the positioning block has a first side formed with an arcuate positioning boss locked in one of the positioning holes of the lower body and a second side formed with a stub secured on an end of the elastic member.

* * * * *